US011035154B2

(12) United States Patent
Caprino et al.

(10) Patent No.: US 11,035,154 B2
(45) **Date of Patent: *Jun. 15, 2021**

(54) RESTRAINT CONDITION DETECTION AND NOTIFICATION SYSTEM, DEVICES, AND METHODS

(71) Applicant: Carl Caprino, Lakewood, NY (US)

(72) Inventors: Carl Caprino, Lakewood, NY (US); Paul Metcalfe, Solon, OH (US); Weston Skye, University Heights, OH (US); Scott Urban, University Heights, OH (US)

(73) Assignee: Carl Caprino, Lakewood, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/665,637

(22) Filed: Oct. 28, 2019

(65) Prior Publication Data

US 2020/0063467 A1 Feb. 27, 2020

Related U.S. Application Data

(63) Continuation of application No. 15/975,231, filed on May 9, 2018, now Pat. No. 10,458,154.

(60) Provisional application No. 62/503,622, filed on May 9, 2017.

(51) Int. Cl.
*E05B 75/00* (2006.01)
*E05B 45/06* (2006.01)

(52) U.S. Cl.
CPC ..... *E05B 75/00* (2013.01); *E05B 45/06* (2013.01)

(58) Field of Classification Search
CPC ..... E05B 75/00; E05B 45/06
See application file for complete search history.

(56) References Cited

U.S. PATENT DOCUMENTS

| | | | | |
|---|---|---|---|---|
| 4,811,775 | A | 3/1989 | Sun | |
| 6,318,137 | B1 * | 11/2001 | Chaum | E05B 49/002 340/5.67 |
| 7,629,892 | B1 | 12/2009 | DeMott | |
| 8,578,742 | B2 | 11/2013 | Shulman | |
| 9,064,391 | B2 | 6/2015 | Vardi et al. | |
| 9,460,612 | B2 | 10/2016 | Vardi | |
| 2005/0172974 | A1 | 8/2005 | Foster et al. | |
| 2007/0289342 | A1 * | 12/2007 | Brooks | E05B 75/00 70/16 |
| 2009/0205384 | A1 * | 8/2009 | Pomerantz | G07C 9/00309 70/278.3 |
| 2011/0199256 | A1 * | 8/2011 | Chu | G08B 21/22 342/357.25 |
| 2012/0298119 | A1 * | 11/2012 | Reese | F41H 13/0018 128/875 |

(Continued)

*Primary Examiner* — Hongmin Fan
(74) *Attorney, Agent, or Firm* — Walter Haverfield LLP; James J. Pingor

(57) ABSTRACT

Systems, devices and methods are provided that illustrate the innovation in a number of embodiments. Device embodiments may be provided singularly or in ordered combinations to provide a system for restraint condition evaluation, compares the evaluation against predetermined thresholds, and signals a status of the selected restraint. Embodiments of status indicators include normal, attempted tampering, and compromised restraints. Methods may illustrate the device or system embodiments. The system provides increased safety and awareness for those involved in processing detainees.

12 Claims, 20 Drawing Sheets

(56) References Cited

U.S. PATENT DOCUMENTS

| | | | |
|---|---|---|---|
| 2013/0012795 | A1 | 1/2013 | Moenning et al. |
| 2014/0340217 | A1 | 11/2014 | Moenning et al. |
| 2016/0330593 | A1 | 11/2016 | Caperell |

* cited by examiner

RESTRAINT CONDITION DETECTION AND NOTIFICATION SYSTEM, DEVICES, AND METHODS

CROSS-REFERENCE TO RELATED APPLICATION

This application is a continuation of U.S. patent application Ser. No. 15/975,231 entitled "RESTRAINT CONDITION DETECTION AND NOTIFICATION SYSTEM, DEVICES, AND METHODS" filed on May 9, 2018, and claims the benefit of U.S. Provisional Patent Application Ser. No. 62/503,622 entitled "HANDCUFFS ALARM" filed on May 9, 2017, the entirety of which is incorporated by reference herein.

BACKGROUND

The application of restraints may arise in varied circumstances and locations. Most often, but not exclusively, these circumstances may involve restraining a person who may want to escape the situation or otherwise defeat the restraints. Such a person may have an interest in tampering with the restraint without detection or notice of those who may be constraining the individual. An ongoing concern is the lack of ability to notice tampering with or defeating of various types of restraints with sufficient notification to a controlling entity.

For a non-limiting example, securely restraining or confining detainees during arrest or travel may serve to protect law enforcement officials, military operators, bounty hunters, and/or the like from those being detained, as well as may in some circumstance protect the individual being restrained from harming themselves or others. Methods of monitoring detainees, detecting tamper conditions, and notifying their captors or other controlling entities when restraints have been breached or tampered with may contribute to keeping captors, the captive, other detainees, and the public safe.

SUMMARY

The following presents a simplified summary in order to provide a basic understanding of some aspects of the innovation. This summary is not an extensive overview of the innovation. It is not intended to identify key/critical elements or to delineate the scope of the innovation. Its sole purpose is to present some concepts of the innovation in a simplified form as a prelude to the more detailed description that is presented later.

The innovation may be reflected in an embodiment for a system for restraint condition detection and notification. The system may include a restraining device that is configured to contain or be associated with a sensing element that selectively senses a condition of the restraining device, a communication component that selectively communicates a sensed condition of the restraining device, and an activation/deactivation component that selectively powers at least one of the restraining device, the sensing element, and the communication component.

The innovation may also be reflected in an embodiment for a secure restraining device that includes a set of restraining elements operative to secure a limb of a detainee (or a body of a detainee), a sensor operative to detect at least one of an abnormal condition in the position or engagement of the restraining elements in relation to the detainee and a predetermined position or engagement, an abnormal motion of a subset of the set of restraining elements in relation to another subset of the set of restraining elements outside of a preset threshold; and an alarm component operative to alert when abnormal conditions are detected by the sensors.

The innovation may be reflected in an embodiment for a method that provides restraint condition detection and notification. The method may include the steps of engaging a portion of a restraining device that indicates that the restraining device is being applied to restrain a limb of a detainee (or a body of the detainee), wherein the engaging activates a sensor subsystem; detecting, by the sensor subsystem a change to selected parameters of the restraining device; evaluating the sensed change to determine whether at least one of a plurality of thresholds have been transgressed; and activating a communication component to indicate at least one of a tamper alert or a breach alert.

In another embodiment, a non-transitory computer-readable medium configured to store instructions, that when executed by a processor, perform operations including one or more of the system and method steps.

To accomplish the foregoing and related ends, certain illustrative aspects of the innovation are described herein in connection with the following description and the annexed drawings. These aspects are indicative, however, of but a few of the various ways in which the principles of the innovation can be employed and the subject innovation is intended to include all such aspects and their equivalents. While the provided embodiments and aspects thereof are described as examples relating the innovation to law enforcement and justice industries, it is to be appreciated that additional applications and industries can be applicable without departing from the spirit and/or scope of the innovation described herein. These additional aspects and embodiments are to be included within the breadth of this specification and claims appended hereto. Other advantages and novel features of the innovation will become apparent from the following detailed description of the innovation when considered in conjunction with the drawings.

DETAILED DESCRIPTION

Figure 1:
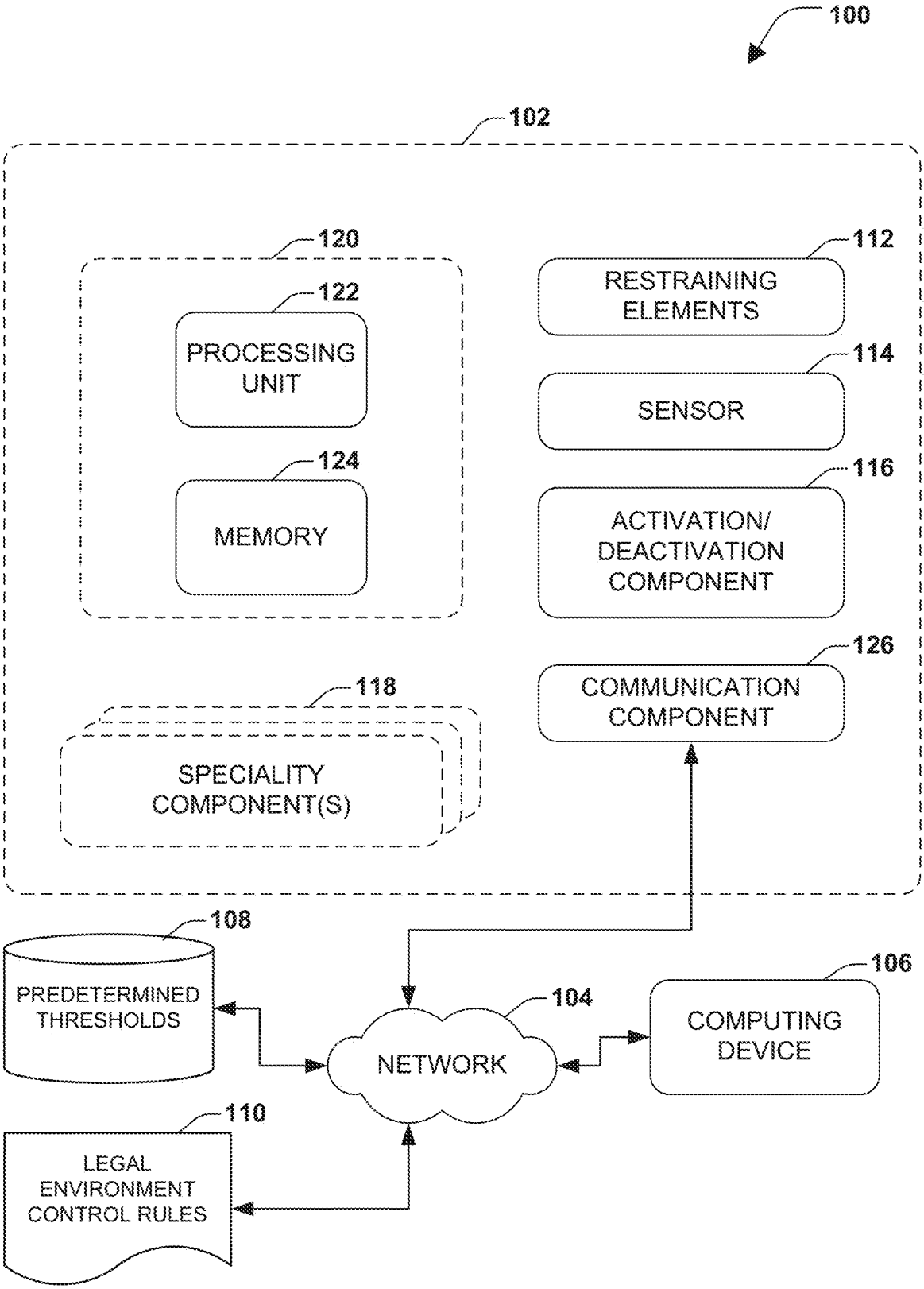
FIG. 1 is an illustration of a high level example system 100 in context with one or more aspects of the disclosure.

The innovation is now described with reference to the drawings, wherein like reference numerals are used to refer to like elements throughout. In the following description, for purposes of explanation, numerous specific details are set forth in order to provide a thorough understanding of the subject innovation. It may be evident, however, that the innovation can be practiced without these specific details.

While specific characteristics are described herein, it is to be understood that the features, functions and benefits of the innovation can employ characteristics that vary from those described herein. These alternatives are to be included within the scope of the innovation and claims appended hereto.

While, for purposes of simplicity of explanation, the one or more methodologies shown herein, e.g., in the form of a flow chart, are shown and described as a series of acts, it is to be understood and appreciated that the subject innovation is not limited by the order of acts, as some acts may, in accordance with the innovation, occur in a different order and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the innovation. Furthermore, the claimed subject matter can be implemented as a method, apparatus, or article of manufacture using programming or engineering techniques to produce software, firmware, hardware, or most any combination thereof to implement the disclosed subject matter. The term "article of manufacture" as used herein is intended to encompass physical elements such as embodied restraint devices, or system which may include a computer program accessible from most any computer-readable device, carrier, or media. It is appreciated that embodiments are presented as a specific, non-limiting, examples of the innovation. Other embodiments are contemplated as well and intended to be included within the scope of this disclosure and claims appended hereto.

As used in this application, the terms "component" and "system" are intended to comprise systems and devices that may include a computer-related entity, either hardware, a combination of hardware and software, software, or software in execution. For example, a component can be, but is not limited to being, a process running on a processor, a processor, an object, an executable, a thread of execution, a program, and/or a computer. By way of illustration, both an application running on a server and the server can be a component. One or more components can reside within a process and/or thread of execution, and a component can be localized on one computer and/or distributed between two or more computers.

FIG. 1 is an illustration of a high level example system 100 in context with one or more aspects of the disclosure. It is to be appreciated that the innovation may be portrayed as a system, as a device, as a device in conjunction or associated with other elements (for example, as a sub-system of a larger system) or as methods associated with systems and/or subsystems. Dotted lines in FIG. 1 are to be understood as reflecting items that may be present, absent or shared in various embodiments.

A system 100 for restraint condition detection and notification may comprise a subsystem 102 in communication with a network 104, and through that communication to a computing device 106, predetermined thresholds database 108 and/or legal environment control rules 110. It is to be appreciated that in some embodiments, computing device 106, predetermined thresholds database 108 and/or legal environment control rules 110 may be captured within subsystem 102, as will be discussed herein. In such embodiments, there may not be a need for communication with a network 104. It is also to be appreciated that in some embodiments, computing device 106 may be controlled, caused to be controlled, or operated in a controlled manner (for example, through suitable encryption of the like), such that access to a control element (as is discussed later in relation to computing capability 120) is itself selectively controlled. It is to be appreciated that communication outside of subsystem 102 may be provided for certain embodiments with configurations for one or more specific situational environments, for example, for environments of a prison system, a court system, or the general public, that may provide for selective legal environment control rules.

Subsystem 102 may comprise restraining elements 112. For example, restraining elements 112 may include a variety of restraint types, from handcuffs, zip tie configurations, to Kuffbags, or the like. These restraining elements may be comprised of known items in the art, or these items may be altered and configured with other elements of the innovation in different embodiments, as will be discussed herein in greater detail in relation to FIGS. 2-6.

Subsystem 102 may comprise one or more sensors 114. For ease of discussion, the one or more sensors may be referred to in the singular. The innovation encompasses either a singular or multiple sensors in various embodiments. Sensor 114 may be of a variety of types of sensors. Sensors may include types for detecting motion. Motion detectors such as accelerometers, vibration sensors, gyroscopes, passive or active infrared sensors, optical and piezoelectric sensors may also be utilized, for example, to detect abnormal motion in the restraining device indicative of an escape attempt. A sensing element is an element that selectively senses a condition of the restraining device, as will be discussed in more detail in relation to FIGS. 2-6. In various embodiments, sensor 114 may be configured and associated with particular embodiments of restraining element 112, as will be discussed in greater detail in relation to FIGS. 2-6. Additionally, restraining elements, such as for example, individual cuffs of a pair of handcuffs may be fitted with sensors within, about, or under the cuffs operative to measure physiological data of a detainee. A sharp decrease in the measured body temperature may indicate, for example, that a detainee has dislocated his thumb and removed his hand from a cuff. Generally, unfavorable disruptive environmental conditions may be sensed. In addition to the above, sensing may include small vibrations that may indicate cutting action, force from excessive twisting (for example, in an attempt to break links between handcuffs or snapping a twist tie type of restraint), or actions that indicate that a mechanical lock-picking device is being attempted to be used (sensing mechanical action that may be provided in contrast with a use of a proper key).

Additionally, protection and safety of a detainee may be augmented in an embodiment, wherein the sensing element may indicate the pressure of the loop of the restraint against the limb (or body) of the detainee to which the restraint is being attached. For more humane treatment, the innovation may process the sensing device output and indicate that a harmful or distressful level of pressure on the limb (or body) has been reached. Such a feedback may inform the captor that a restraining device may be too tight. In the state of the art, a normal measure of this type of feedback is the unreliable personal testimony of a detainee. As a detainee may not be truthful in regards to such a condition (for example, to facilitate the detainee's later attempt at escape), it has been prudent for the controlling entity to discount or ignore this feedback. Sensor types such as accelerometers may detect if a wearer is trying to smash or bang a restraining device. Force type sensors may detect tightness when applying a restraining device, or as above, detect if a banging or smashing is being attempted, or may detect if a restraint is loosened beyond a predetermined threshold. It is further to be appreciated that in some embodiments, sensor sensitivity may be recalibrated, updated, modified or changed as may be desired. For example, as will be discussed later, an App on a smart phone may be used to update or modify sensor settings.

Subsystem 102 may comprise an activation/deactivation component 116 that provides for power and power control to one or more elements of subsystem 102, including, for example, sensor 114. It is to be appreciated that in some embodiments, power may be sourced from a battery within subsystem 102 (which may be an example of specialty components 118). In other embodiments, power may be generated by the physical action associated with restraining elements 112 (i.e., motive power). In other embodiments, power may be capable of being transferred to subsystem 102 from outside of subsystem 102 through an RF transponder or the like. It is to be appreciated that specialty components 118 may include such power receivers and power control may be provided by activation/deactivation component 116 so as to apply power to various subsystem 102 components and/or conserve power available. Another specialty component may be a GPS unit. It is to be appreciated that sensor 114 may be adapted to detect attempts to alter or tamper with subsystem components, such as, but not limited to activation/deactivation component 116 in addition to restraining elements 112.

Subsystem 102 may comprise computing capability 120. Computing capability 120 may comprise a processing unit 122 and a memory 124. It is to be appreciated that in some embodiments of the innovation, computing capability 120 may replace computing device 106, and memory 124 may be programmed to capture, or selectively be updated to include predetermined thresholds and legal environment control rules that in other embodiments may be reflected external to subsystem 102 in predetermined thresholds database 108 and legal environment control rules 110. Computer capability 120 provides a control element that may receive sensed condition(s) of the restraining elements 112 from a communication component 126 and selectively provides an indication of a tamper attempt or restraint failure. In some embodiments, a communication component 126 may include light emitting diodes (LEDs) that indicate the state of the device. For example, LEDs of one color could illuminate when the device is secure and LEDs of another could illuminate when the device is unlocked and/or defeated (e.g. in an alarm state), while a third could indicate a tamper condition. Alternatively, the device could be fitted with LEDs that illuminate when the device has just been defeated.

Subsystem 102 may comprise communication component 126 that provides communication capabilities to and/or from subsystem 102. It is to be appreciated that communication component 126 may be configured to provide different capabilities depending on the specific embodiment of the innovation. In some embodiments, communication component 126 may be configured to provide communication capability to network 104. In other embodiments, communication component 126 may be configured to provide communication capability directly to computing device 106. In other embodiments, communication component 126 may be configured to receive direct inputs from operators of subsystem 102. Activation/deactivation component 116 may selectively power/draw power from at least one of the restraining elements 112, the sensing element sensor 114, and the communication component 126. In embodiments, communication component 126 may also include various notification means, including audio, visual, and tactile means, as will be discussed in greater detail herein in relation to FIGS. 2-6. As should be appreciated, the notification means may be adapted to provide notifications either local to subsystem 102, or to locations external to subsystem 102 (of intermediate or distant locations), as for example, through network 104. Communication component 126 may include more than one type of notification (for example, more than merely visual) and may provide notification to more than one location (for example, both local to subsystem 102 and away from subsystem 102). It is to be appreciated that communication component 126 may selectively communicate a sensed condition as provided by sensor 114 associated with restraining elements 112, activation/deactivation component 116 or other components of subsystem 102.

Communication component 126 may provide (or through communication to external-to-subsystem elements, such as for example, a prison riot control system) notifications, alarms and other measures. Alarm indications may be audible, visual, or tactile. Alarm indications may also be silent, with notification only selectively (for example, not to tip off a detainee attempting to tamper or break a restraining device). It is to be appreciated that one or more of these modes may be used. Signals to situationally specific environments (for example, within a prison), may provide inputs to door lock, riot control and suppression or other control systems. For an additional example, use in a prison system may provide tracking and trending data.

In some embodiments, restraining device elements may be in the form of a pair of handcuffs. Handcuffs may include two cuffs or restraints that are connected by a chain or other linking implement. Each cuff may comprise at least front and rear cheeks having enlarged head portions, two arcuate jaws pivotally connected to the cheeks, the arcuate jaw having teeth that move between the cheeks and engage a pawl. Each cuff may be fitted with a lock or locking mechanism. Handcuffs may be fitted with sensors operative to detect when a handcuff lock has been disengaged. Handcuffs may also be fitted with sensors operative to detect when an arcuate jaw has disengaged from its associated pawl. Handcuffs may also be fitted with sensors that measure the distance between the cuffs themselves or links of an associated chain exceeds a preset threshold in order to alert a captor when the linking mechanism has been broken.

Other types of restraining device elements may be used in other embodiments. For example, in another embodiment a restraining device may include zip ties as an operative element. Such a device may be equipped with a tensile strain sensor to detect attempts by a detainee to sever a tie. In other embodiments, a restraining device may be a Kuffbag or similar implement. In some embodiments, a Kuffbag can limit the ability of detained hands to grasp objects in the environment. Sensors operative to measure structural integrity of the sack comprising the Kuffbag body may be utilized. Further, Kuffbags may be fitted with grommets to allow the additional use of handcuffs, zip ties, or similar restraining elements. One or more sensors located within the Kuffbag may work in conjunction with sensors on additional restraining devices.

Figure 2A:
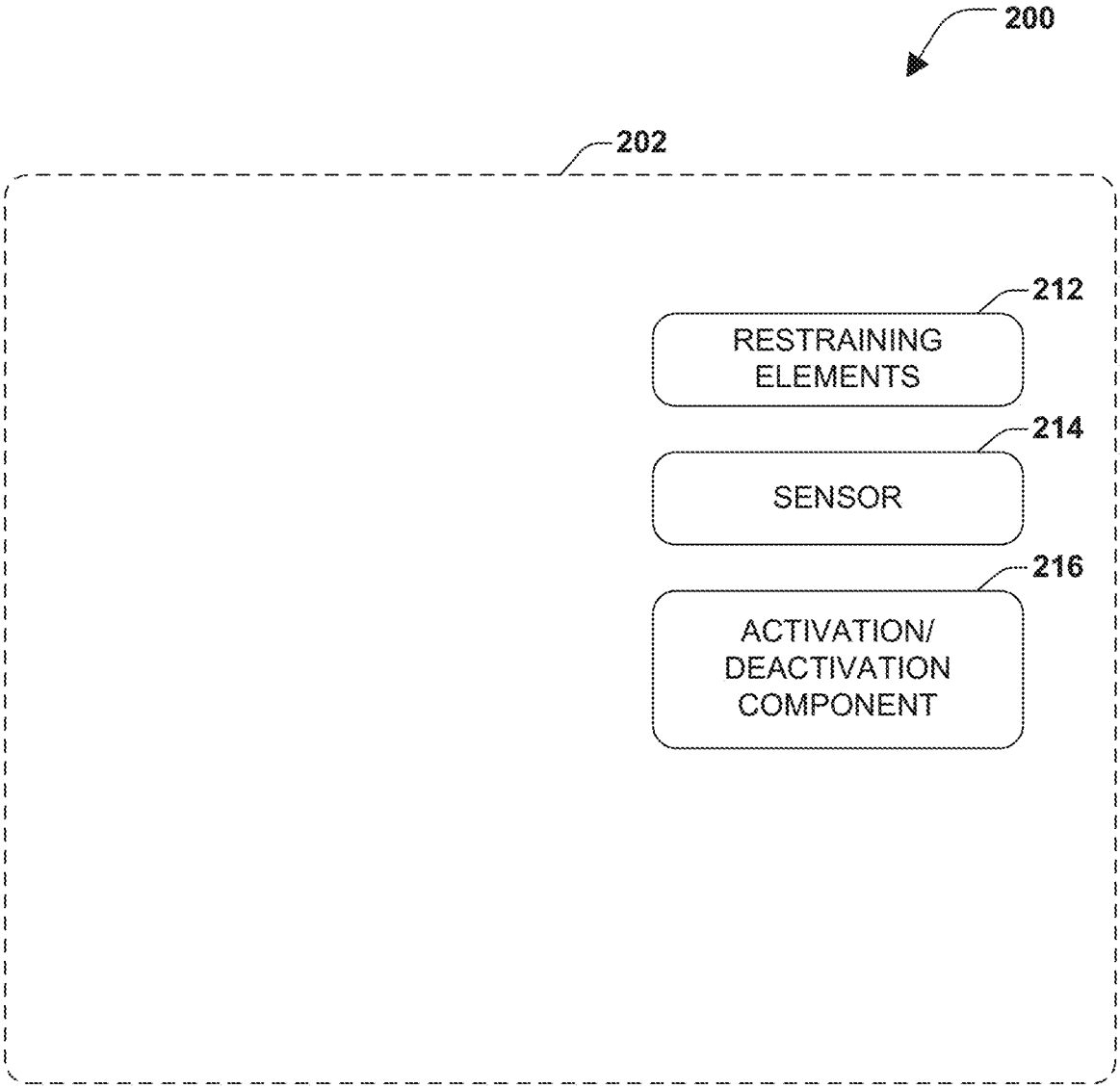
FIGS. 2A-2O provide illustrations of example device 200 according to one or more embodiments.

Turning to FIGS. 2A-2M, embodiments of a restraint condition detection and notification system are disclosed, particularly in reference to embodiments with subsystem 202 and particularly in reference to restraining elements 212, sensor 214 and/or activation/deactivation component 216. It is to be appreciated that FIG. 2A presents embodiments of subsystems and elements as may be provided by similarly numbered items as provided in relation to FIG. 1.

Figure 2B:
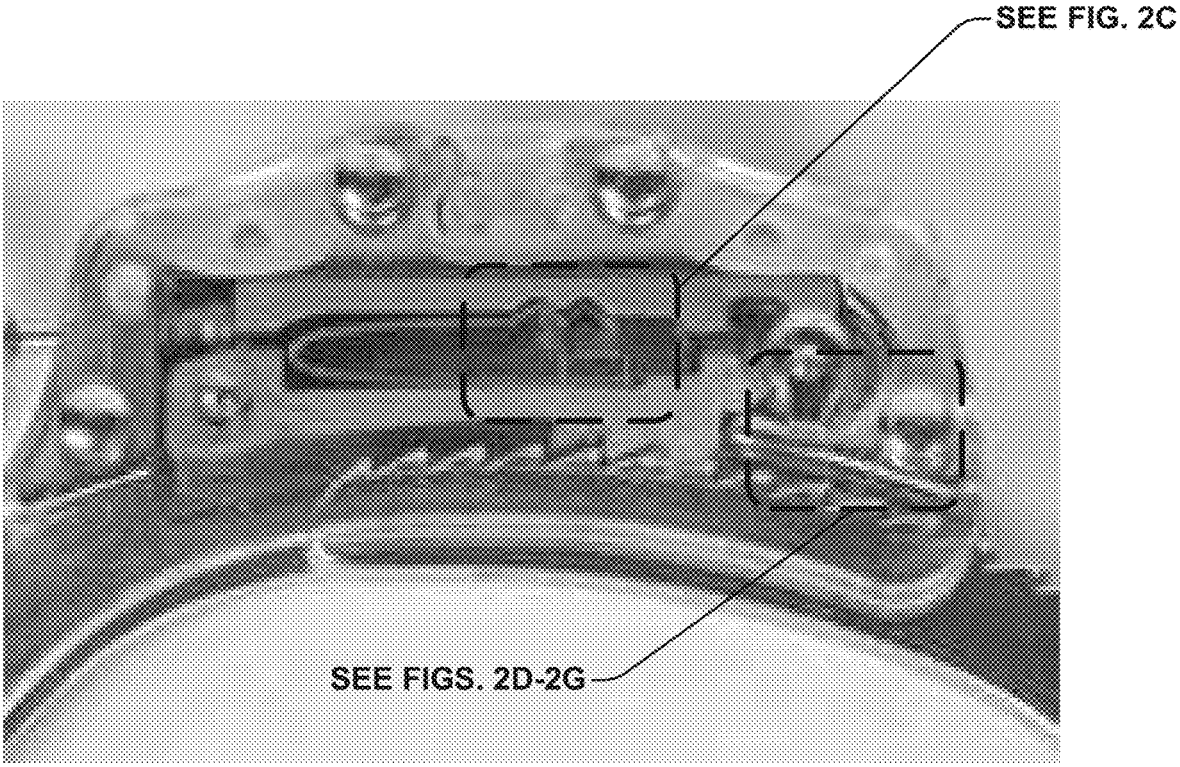

FIG. 2B provides for a color photograph with multiple embodiments of sensor 214, both in type and in placement or configuration. It is to be appreciated that the innovation may in some embodiments present a singular mode, and in other embodiments, may present in multiple modes. In some embodiments, one mode may act as an activation/deactivation component 216, while another mode may operate as a sensor 214. In other embodiments, a singular mode may operate as both a sensor 214 and as an activation/deactivation component 216. It is to be appreciated that in the discussion that follows, an item discussed as activation/deactivation component 216 may also serve as sensor 214.

Figure 2C:
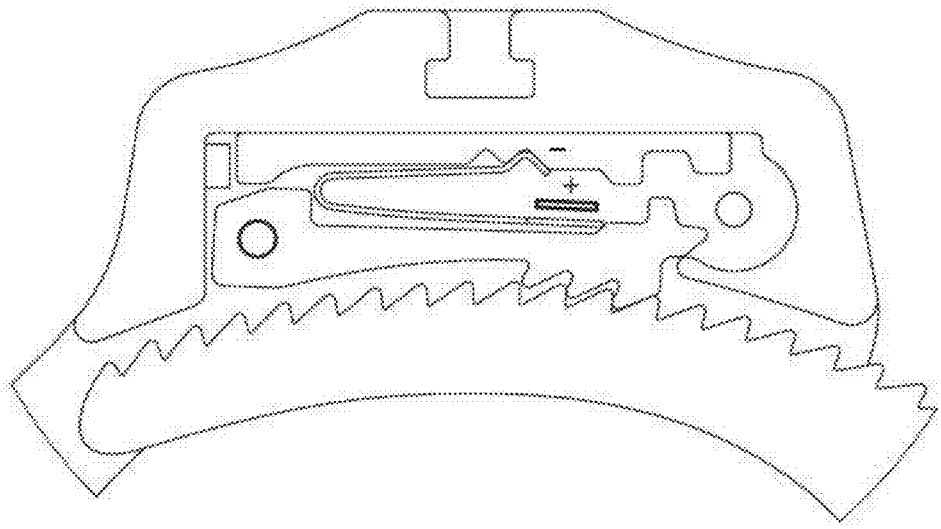
Figure 2D:
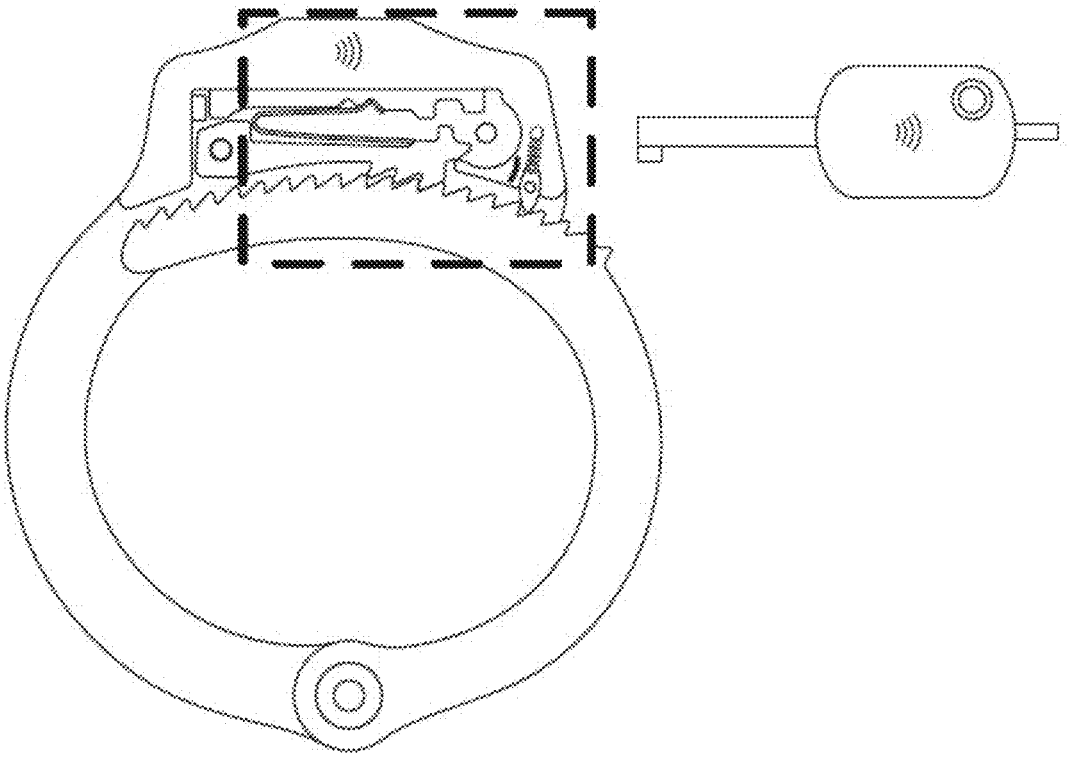

FIG. 2C illustrates a set of embodiments of a restraining device being a handcuff. In this figure, Activation/Deactivation component 216 may be configured as a proximity sensing device located at a handcuff spring location. Thus when the handcuff is first engaged in the act of restraining a limb, for example, the action of the arcuate jaw passing through the main body of the handoff, with the teeth of the arcuate jaw engaging its mating item within the handcuff main body power to activate the subsystem 202 may be provided. Alternatively, power may be provided by another means, such as, for example, a battery. Sensing is accomplished as one end of the configuration comes within a predetermined distance of another end of the configuration. It is to be appreciated that in some embodiments of this set, proximity switching is an enabling mode, while in other embodiments, contact is an enabling mode.

Figure 2E:
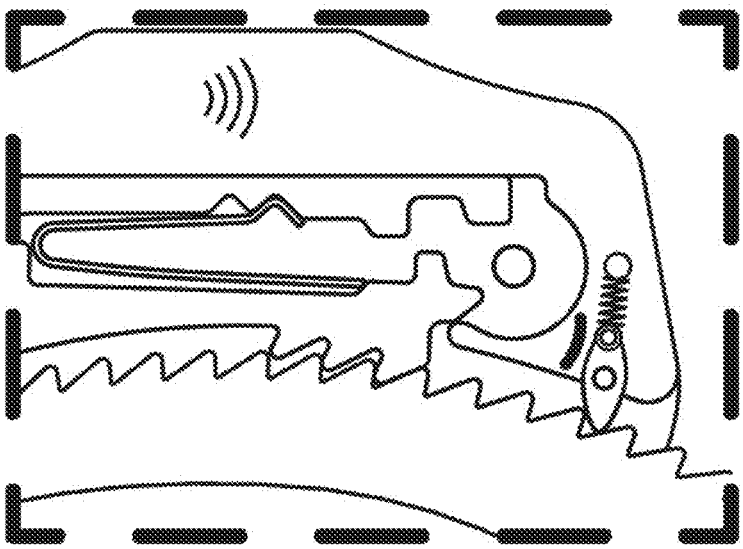
Figure 2F:
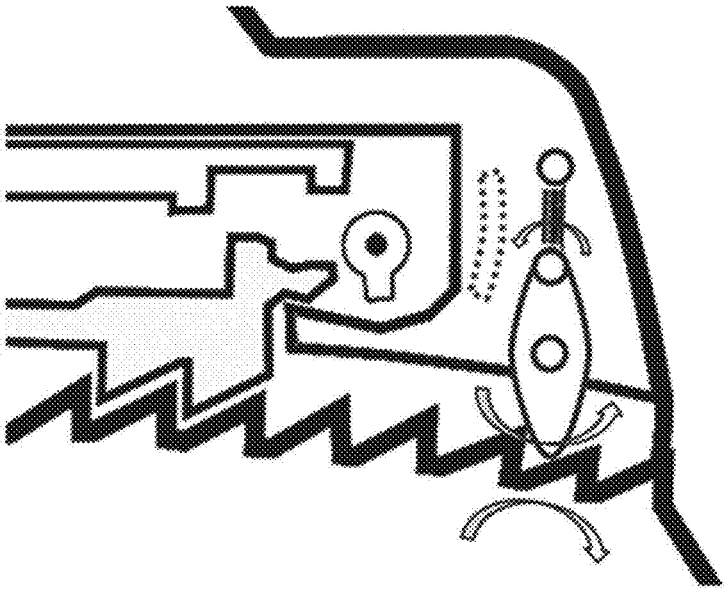
Figure 2G:
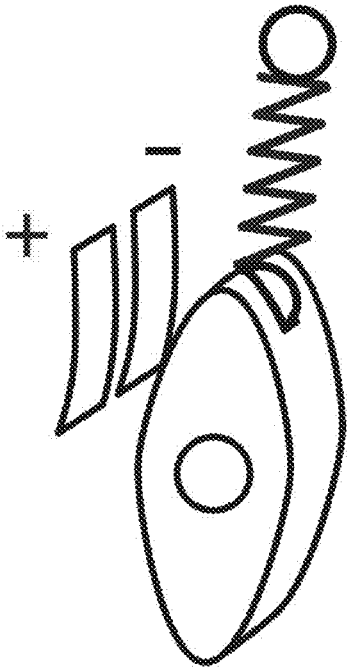

FIGS. 2D-2G illustrate a set of embodiments, also of the restraining device being a handcuff, and that Activation/Deactivation Component 216 may be configured as a rocker element. FIG. 2E provides a closer view of an example configuration of one item in the set of embodiments. It is to be appreciated that the rocker element provides for a "near-field" element circuit configuration, much as a near field effect as may be achieved in the different configuration of FIG. 2C. As the action of the restraining element of the arcuate teeth of the one arm of the handcuff engages through the main body of the handcuff, the rocker element pivotally moves about its pivot point, brining one portion of the rocker into a proximate relation to a pick-up element. As noted, the restraining element motion may impart a force for activation. FIG. 2F provides a view showing the relative motion of one portion of the restraining elements (e.g., teeth of an arcuate arm that rotates counterclockwise in the view presented when closing and clockwise when opening. It is to be appreciated that the innovation may provide for static as well as dynamic analysis of the circuit action as the rocker element reflects the action of the restraining element as shown. An isometric view for additional clarity is provided in FIG. 2G.

Figure 2H:
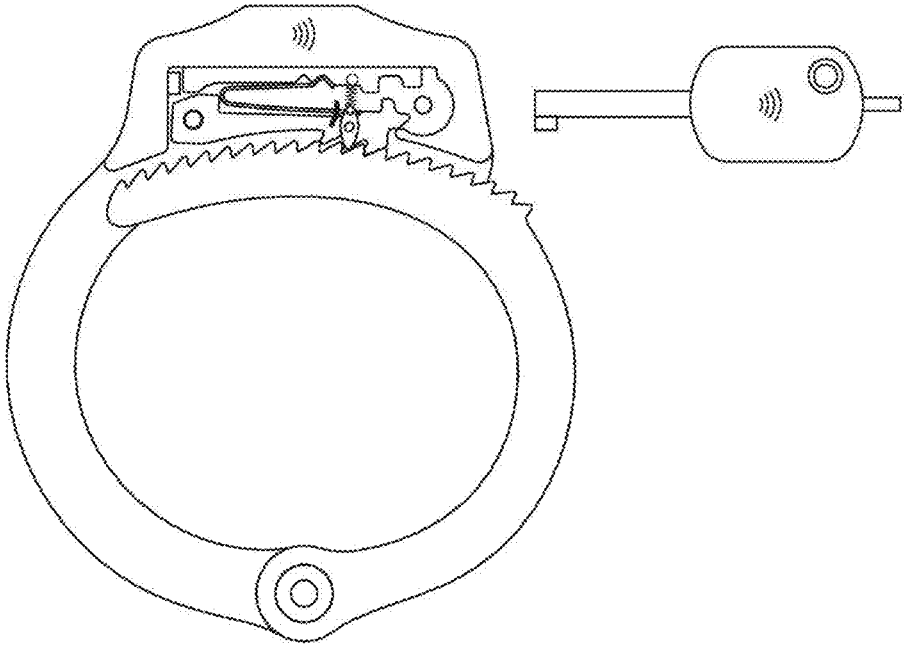
Figure 2I:
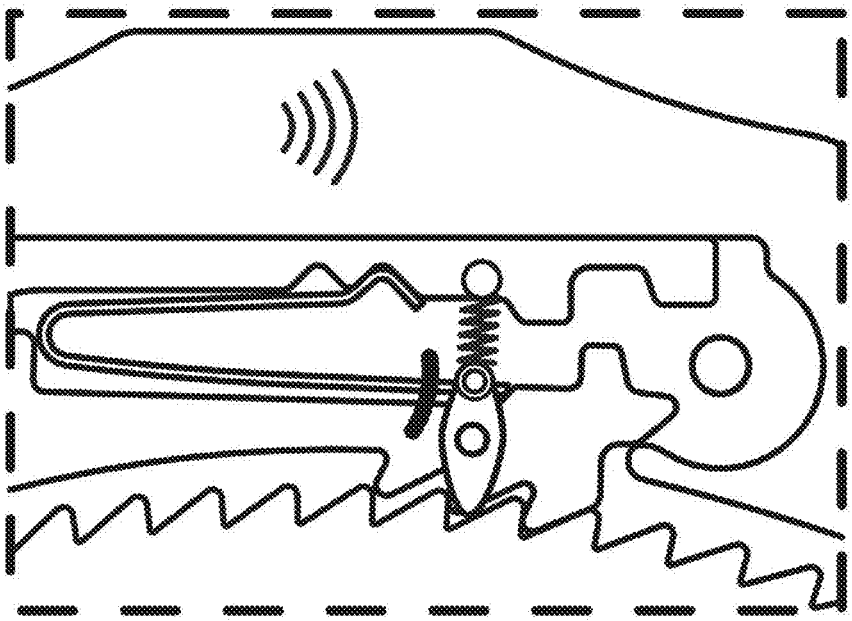

It is to be appreciated that the configuration of such a rocker element may vary as may be desired. For example, FIG. 2H shows an alternative configuration with the rocker element located in a different portion of the handcuffs. FIG. 2I shows a closer view of this alternative configuration.

Figure 2J:
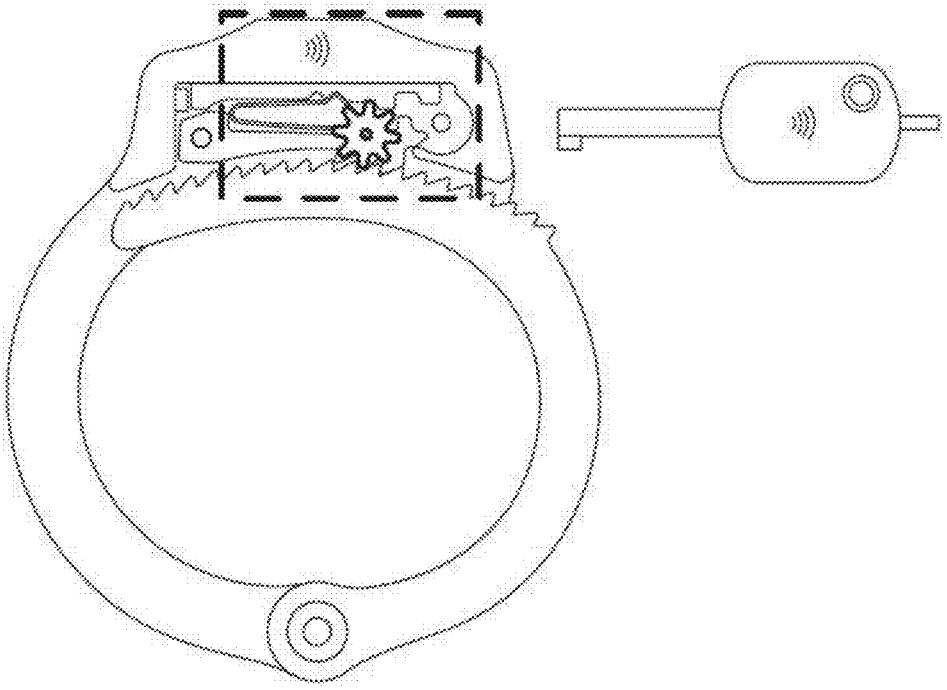
Figure 2K:
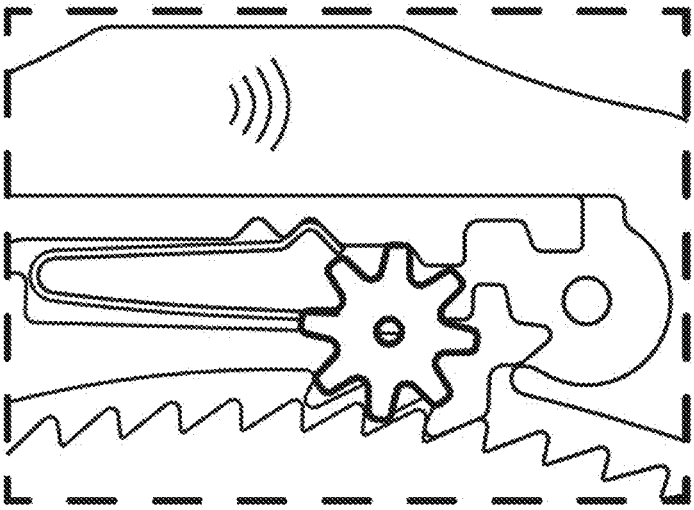
Figure 2L:
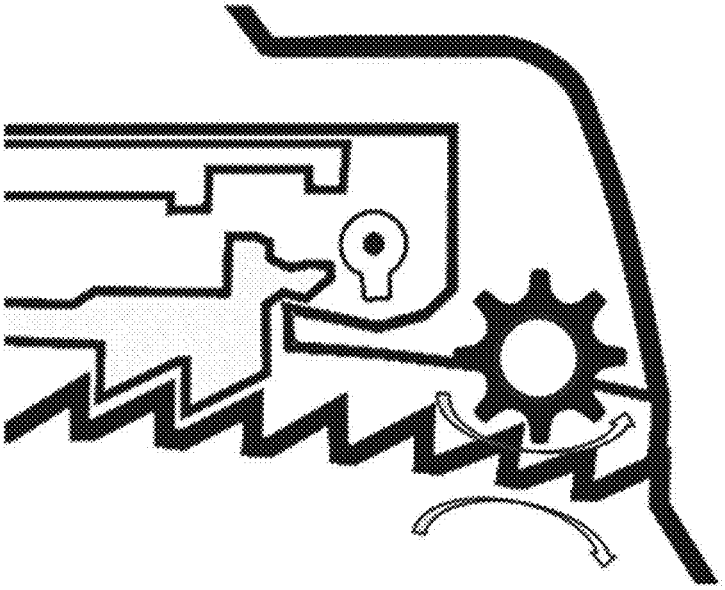

FIGS. 2J-2L illustrate yet another set of embodiments in which the restraining device being a handcuff, and that Activation/Deactivation Component 216 may be configured as a rotary encoder element. FIG. 2J illustrates a wide view; while FIG. 2K illustrates a closer view. As may be appreciated, much like the rocker element, a set of embodiments configured with a rotary encoder element may contain some embodiments with the location of the rotary encoder element in different relative locations. FIG. 2L illustrates a view not only of such a different location, but also illustrates a relative motion between the actuating mechanism of teeth of an actuator arm engaging a handcuff body may impart to the sensing element of the rotary encoder. It is to be appreciated that at least in this set of embodiments, the direction of the relative movement of the teeth during their relative movement may be directly captured by the rotary encoder element. With this set of embodiments, this direct capture of relative emotion (including direction) may provide an Activation/Deactivation component 216 with activating with initial movement in one direction, and an awakening from a sleep mode with motion in a different direction. In other embodiments, such activating and awakening from sleep mode distinctions either may not be made, or may be made by analyzing data received from a sensing element that may then be communicated to other system elements, (for example, as discussed in relation to FIG. 1, communication component 126 of FIG. 1 may communicate data to computing element 120 or external to subsystem 102 to computing device 106. Further, it is to be appreciated that power levels may be communicated in a predetermined manner. For example, an embodiment with a battery may provide for a flashing or pulsing of light or sound when power levels drop to a certain threshold.

Figure 2M:
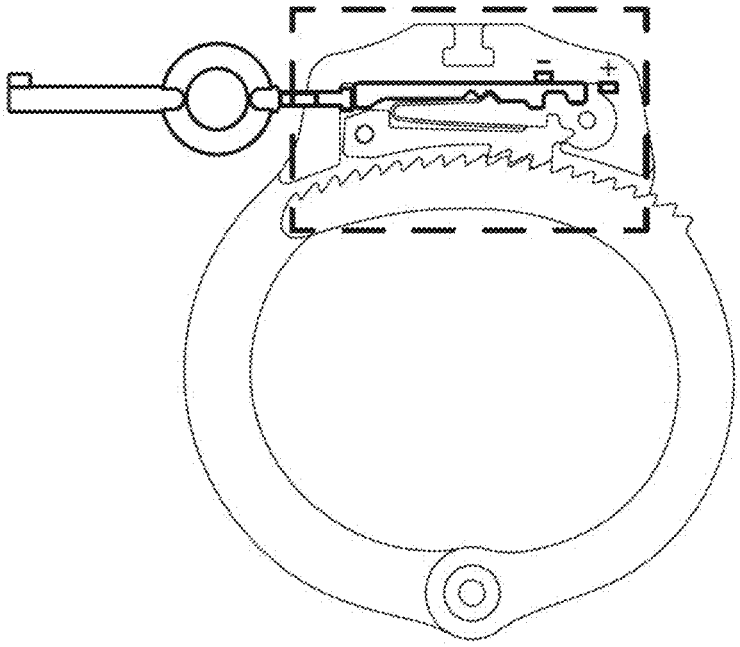
Figure 2N:
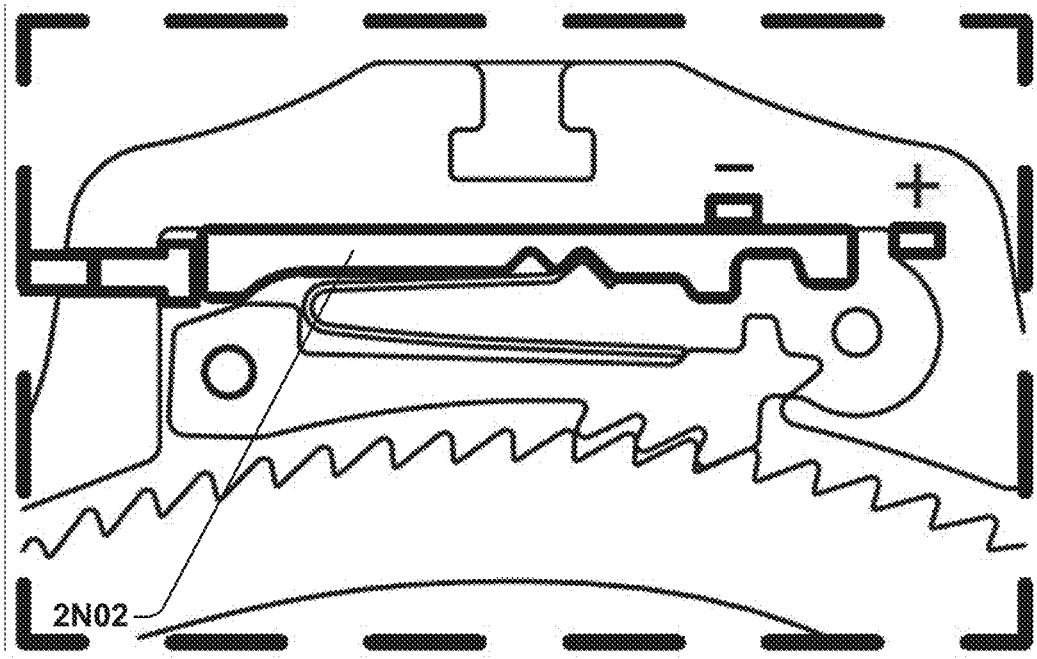

Turning now to FIGS. 2M and 2N, illustrated is another embodiment featuring an Activation/Deactivation component 216. In this embodiment, a rod or a like protrusion which may be provided with a handcuff key may inserted into a separate port configured into the handcuffs. The insertion of this rod displaces element 2N02 from an "off" position to a "ready" position. This embodiment provides for a positive physical change in the configuration of the activation of the restraining system. This "one-way" action may be desired in certain circumstances such as for example, once activated, a detainee may not then possess a ready manner of deactivating the restraints with mechanisms typically available to detainees. It is to be appreciated that a handcuff body may be opened to reset this embodiment. As discussed herein, similar to an embodiment in which a battery panel for replacement of battery power may be provided with an access point occluded by a detained limb, for example, access for possible opening or other resetting of slider embodiments may be likewise occluded.

Figure 2O:
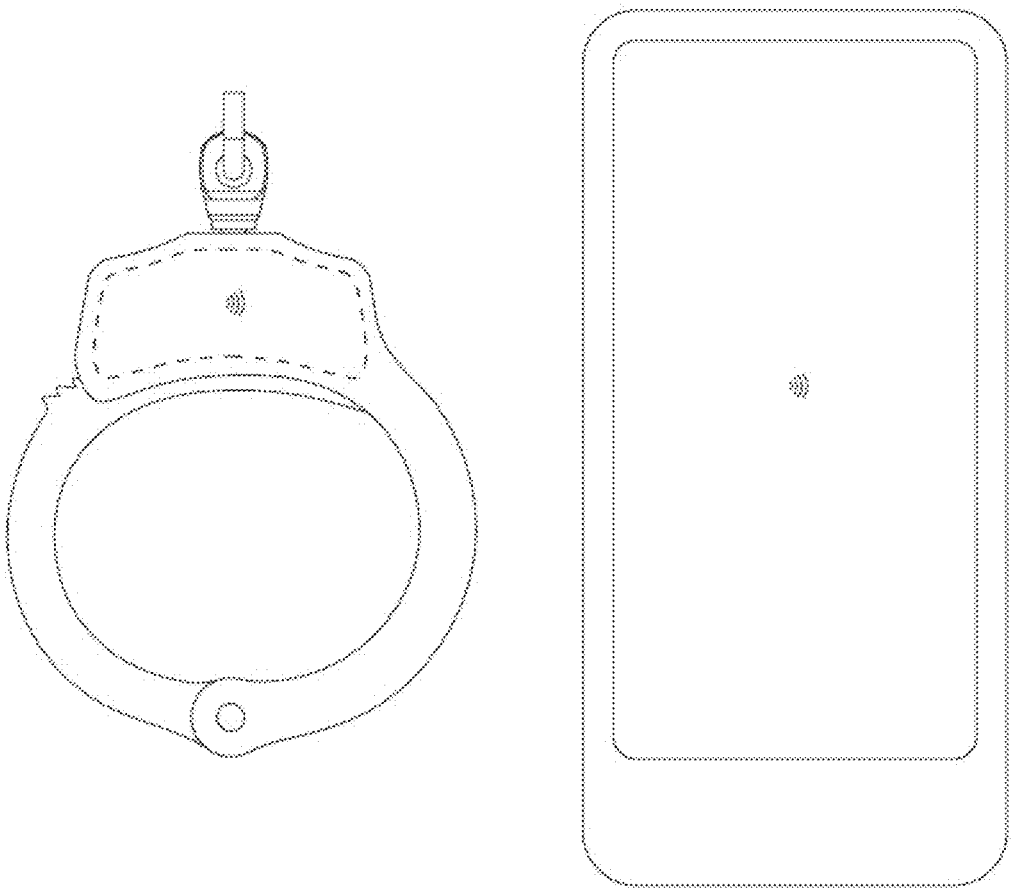

The final figure of the set of figures for FIGS. 2A-2O, FIG. 2O illustrates a set of embodiments in which an Activation/Deactivation component 216 may be activated separate from the restraining device with the use of a smart phone or the like and an App on the smart phone or the like. Subsets of this set of embodiments may differ by type of communication. For example, communication may be analog or digital. Communication may be via Bluetooth or non-Bluetooth. It is to be appreciated that such embodiments may employ either encryption or other controls for the smart phone and the like such that mere access of the device with the App alone would not permit a deactivation with Activation/Deactivation component 216 and thus prevent a defeat of the purpose of the restraining system.

Turning now to FIGS. 3A-3L, illustrations of embodiments of the innovation highlighting another aspect are presented. The focus in the illustrations of these embodiments concerns a restraining device that may typically utilize a key to release a detainee's limb (or body) from the restraint. It is to be appreciated that while the discussion focuses on physical keys for clarity sake, the innovation also encompasses keys such as biometric keys as well as cryptographic keys. It is to be appreciated that computing elements may be configured to not only obtain a biometric key, but may also provide sensing of the provider of the biometric (for example, the provider's heartrate, or body temperature and the like), and monitor for distress situations.

Figure 3A:
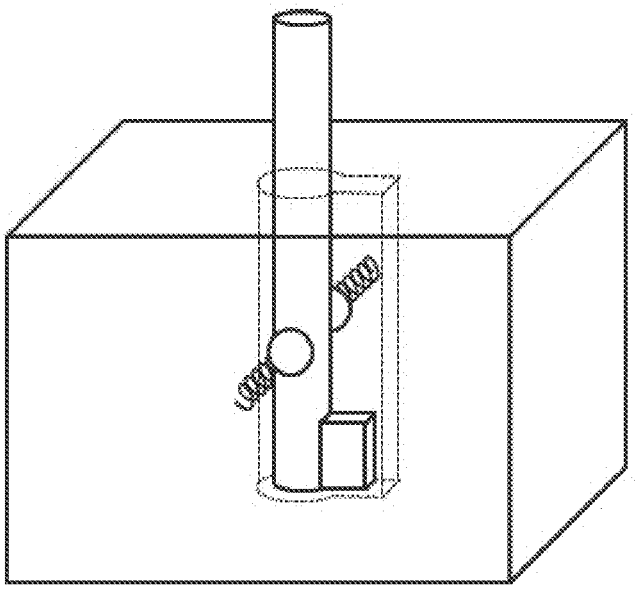
FIGS. 3A-3L provide illustrations of further example elements according to one or more embodiments 300.
Figure 3B:
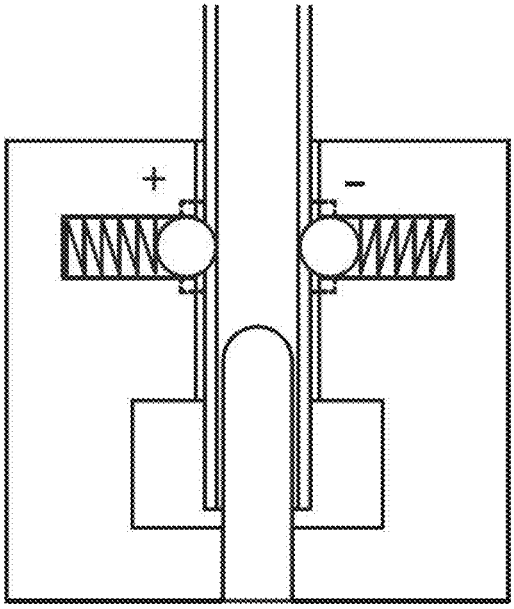
Figure 3C:
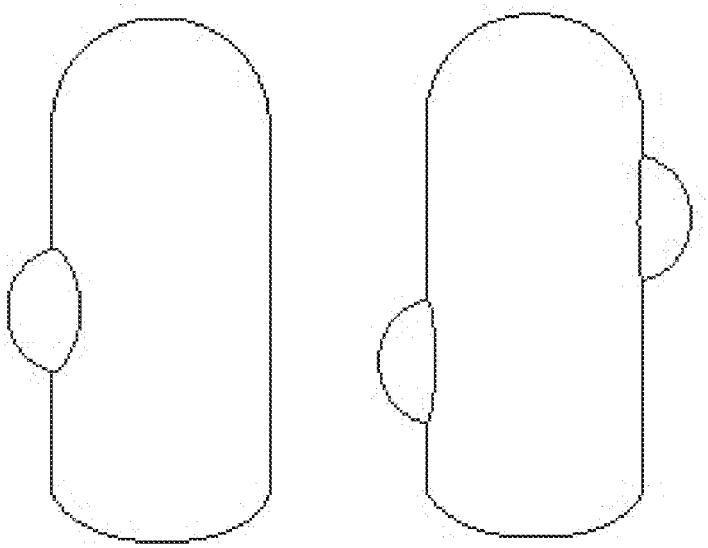

FIG. 3A illustrates a simplified isometric view of a key present in a locking mechanism. In this subset of embodiments, a physical key may provide force to displace detents within the restraining device. Displaced detents may, as indicated in related cutaway view of FIG. 3B, provide for shutting off a circuit control. Such shutting off may indicate a proper release of the restraining element, and thus may deactivate an otherwise alarm condition of a portion of restraining elements opening, and releasing a detained limb (or body). FIG. 3C illustrates a number of optional configurations of potential keyway detent configurations. It is to be appreciated that a number of such configurations may provide assistance in defeating attempts to defeat a detainee from fooling the system with a lock-pick, paper clip or the like.

Figure 3D:
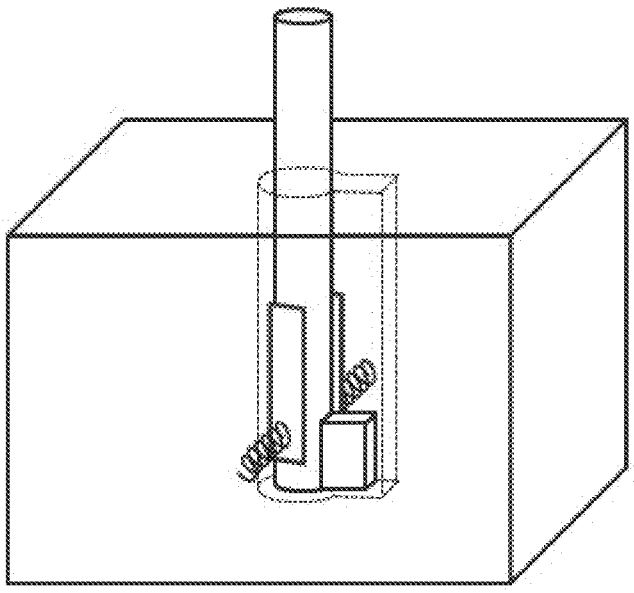
Figure 3E:
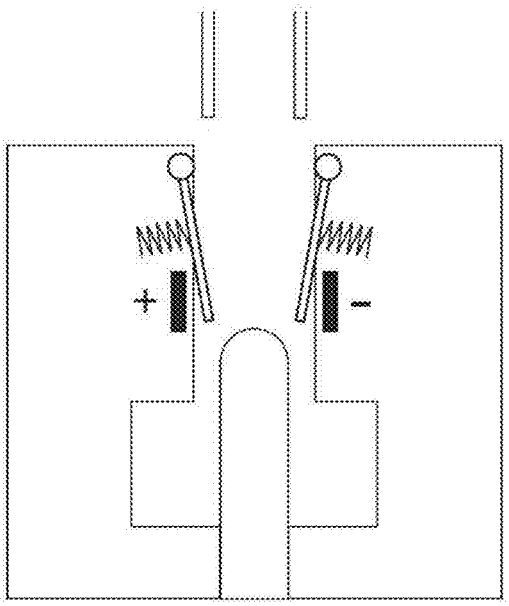

FIGS. 3D and 3E illustrate a simplified isometric view of a key present in a locking mechanism and a related cutaway view. Disclosed rather than a detent mode is a plate switch mode. With the presence of a key in a lock key way, a shutting off may indicate a proper release as disclosed in relation to FIGS. 3A-3C. It is to be appreciated that such a plate switch mode while pictured symmetrically for clarity may be configured nonsymmetrical.

Figure 3F:
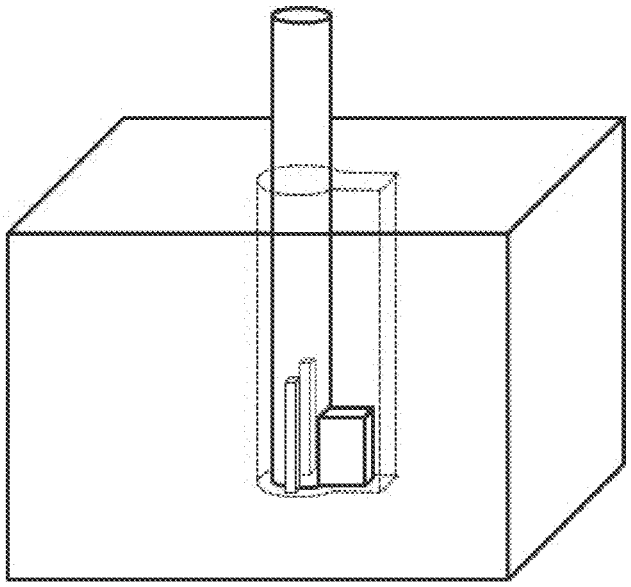
Figure 3G:
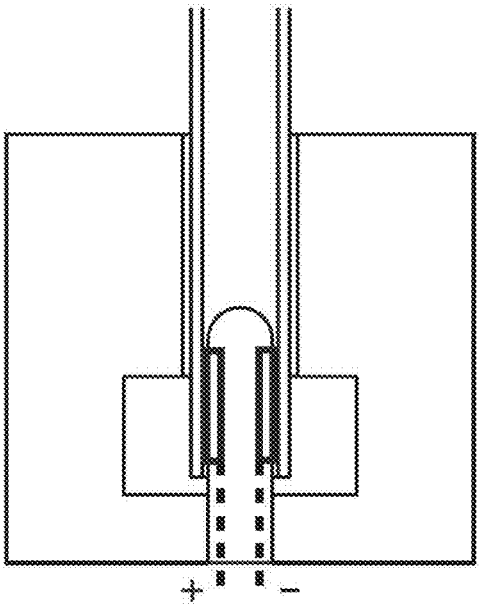

Other subsets of embodiments which provide for the innovation in this aspect may be as illustrated in FIGS. 3F and 3G. FIG. 3F illustrates an isometric view with terminal elements provided in a configured key. FIG. 3G shows a cut-away view and indicates how the terminal elements in the configured key provide for the deactivation that may indicate a proper release of restraint elements.

Figure 3H:
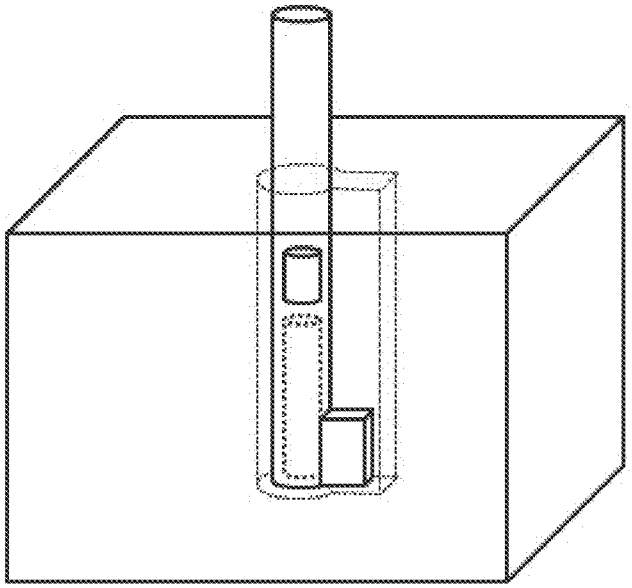
Figure 3I:
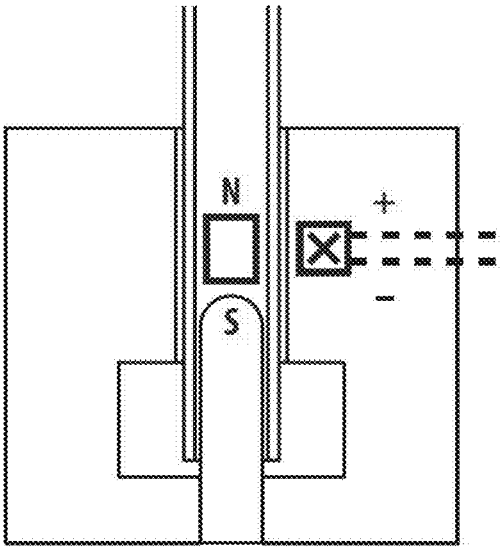

Other subsets of embodiments which provide for the innovation in this aspect may be as illustrated in FIGS. 3H and 3I. FIG. 3H illustrates an isometric view with a magnetic element provided in a configured key. FIG. 3I shows a cut-away view and indicates how the magnetic elements in the configured key provide for the deactivation that may indicate a proper release of restraint elements. It is to be appreciated that a magnetic element may actuate an electrical or mechanical switch or the like.

Figure 3J:
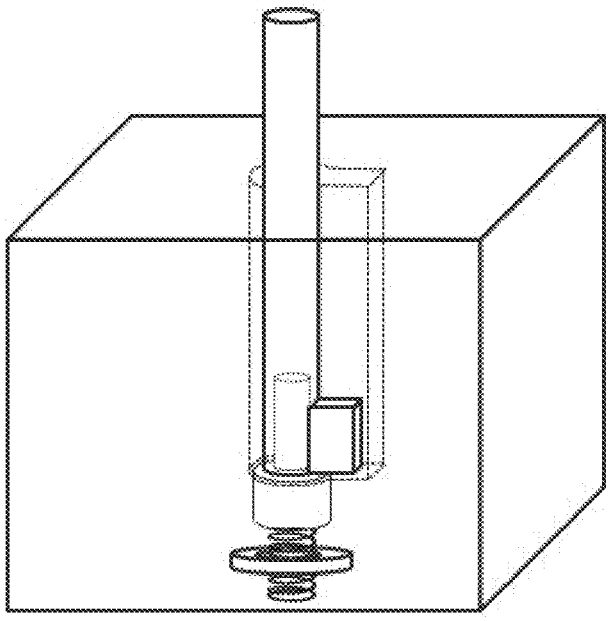
Figure 3K:
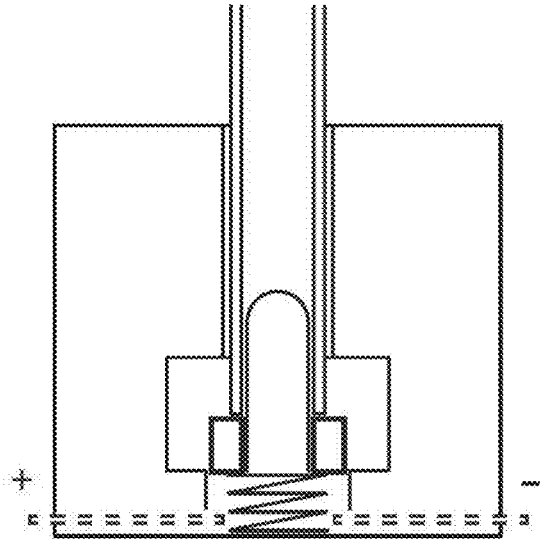

Other subsets of embodiments which provide for the innovation in this aspect may be as illustrated in FIGS. 3J and 3K. FIG. 3J illustrates an isometric view with a "spring and post" provided in a mating configured key and restraint subsystem. FIG. 3K shows a cut-away view and indicates how such a "spring and post" mechanism in the configuration may provide for the deactivation that may indicate a proper release of restraint elements. It is to be appreciated that possible configurations within this subset of embodiments may alter the post such that, for example, a post in the center of the keyway may mate with a hole provided in a matching key, thus provided a "shell" that may engage a spring-like portion and displace the spring-like portion in order to provide the deactivation that may indicate a proper release of restraint elements. An alternative embodiment (not shown) may be a button at the base of the inside of the keyhole, and a mating protrusion on the key. Such a button may be configured to defeat most all paper clip and the like attempts at tamper or breach by requiring a force to depress that would bend or deform at a predetermined level above which most all clips and the like would deform.

Another set of embodiments (not shown) may utilize an optical sensor to determine whether sufficient indicators of a standard key are present when restraining elements are moving towards an open position of the restraining device.

Figure 3L:
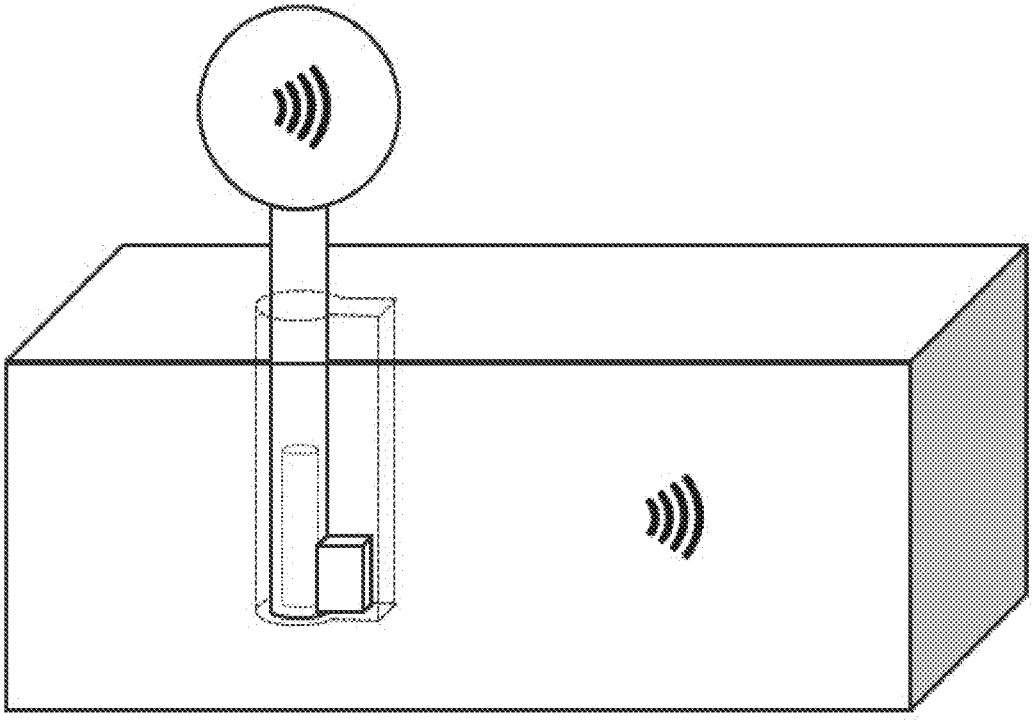

Another subset of embodiments which provide for the innovation in this aspect may be as illustrated in FIG. 3L. FIG. 3L illustrates an isometric view with a configured key equipped with an emitter element (not shown). Emitter element may provide a signal to indicate a deactivation that may indicate a proper release of restraint elements. Such a signal may be provided by RF, NFC, BLE, or the like. It is to be appreciated that with such a subsystem embodiment, a standard key may still be used to release detaining elements of the restraining device, but that an alarm mode may not be deactivated with the use of such standard keys. Such an embodiment may provide advantages of allowing or a controlled release (for example, for an emergency situation such as an accident), while still providing a condition detection and notification capability. It is to be appreciated that in some embodiments, an emitter element may be provided separate from a key, for example, as distinct fob (not shown), or as an component in a separate computing element (not shown).

Figure 4:
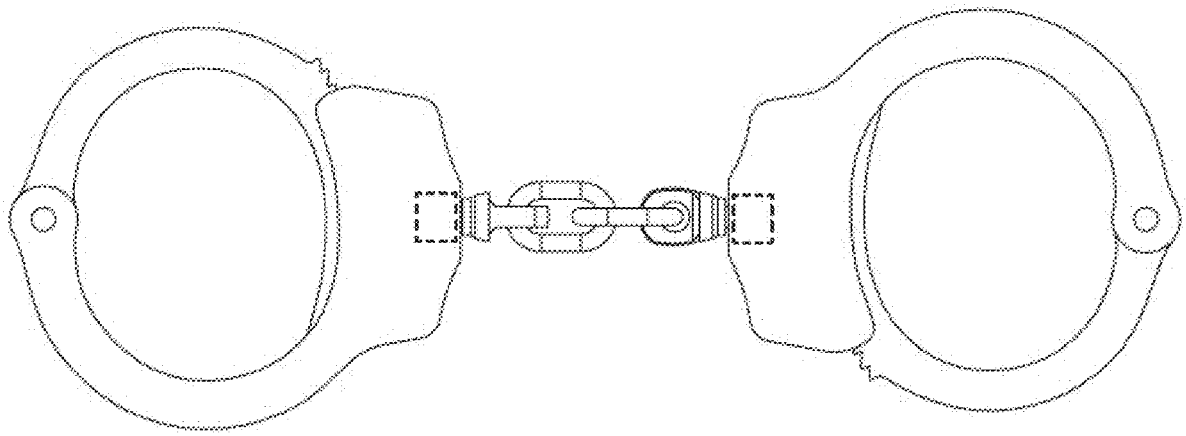
FIG. 4 is an illustration of example system components, according to one or more embodiments 400.

Turning now to FIG. 4, an illustration of a set of embodiments is presented that highlight another aspect of the innovation. While pictured is a restraining device in the form of handcuffs for clarity, it is to be appreciated that the set of embodiments may include other types of restraining devices. In the illustration, sensor elements 402 may be configured to provide sensing of one or more restraint conditions, sensor element 402 may provide a static or dynamic data capture of tension on chain or other connecting members between portions of a restraining subsystem. Dynamic capture may indicate actions that may be reflective of attempts to saw through the chain of other connecting member. Static capture may indicate a one-time application of force that may be sufficient to render the chain of other connecting member weakened or broken. Further, separately or in addition, sensor element 402 may reflect a predetermined threshold distance of one sensor element 402 from a mating sensor element 402 in a configuration of a restraining device that may feature such a mating pair (for example, in a set of separate cuffs that make up a pair of handcuffs. It is to be appreciated that the sensor may provide data indicating a condition that the cuffs have been separated a distance greater than permitted if a chain or other connecting member have been in an expected working condition.

In some embodiments, a system may include a restraining device operative to secure the hands and wrists of a detainee. The device may include sensors operative to detect device conditions. Device conditions may include position of the restraints in relation to the detainee, motion (including abnormal motion) of the components of the restraining device in relation to each other, distance between components of the restraining device above preset thresholds, and/or the physical condition of the detainee. System may include an alarm component operative to alert a captor (or a separate device used by a captor(s)) when abnormal system conditions are detected. A subsystem may also include a power source to provide power to the sensors, alarm, and etc. The power source may include batteries.

It is appreciated that restraining device may be in the form of shackles, handcuffs, zip ties, Kuffbags, and/or the like, where the restraining device includes one or more elements as described above.

Figure 5:
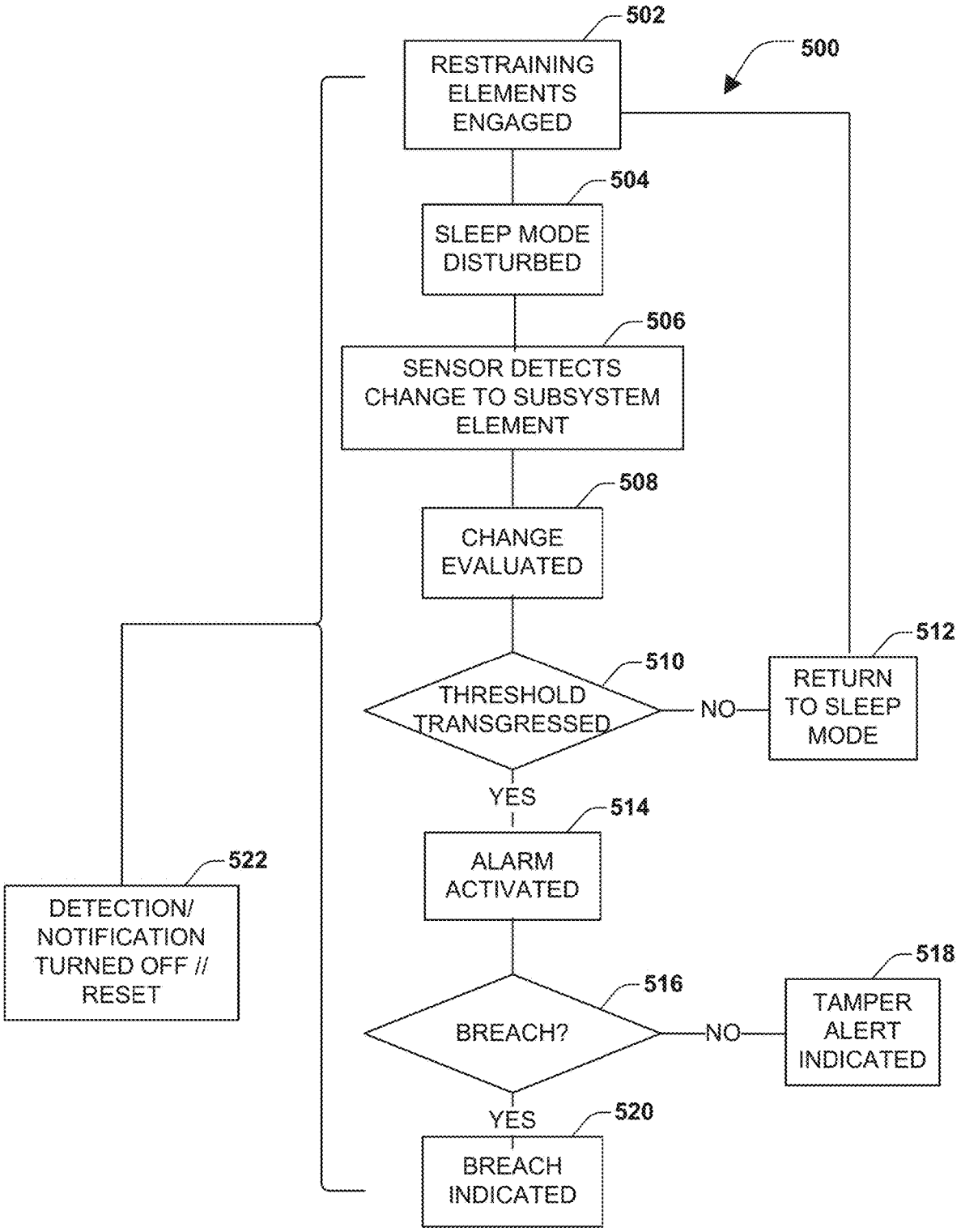
FIG. 5 illustrates an embodiment of a method 500 according to one or more aspects of the disclosure.

Turning now to FIG. 5, a method 500 according to one or more aspects of the disclosure is illustrated. Starting at 502, restraining elements of a restraining device in a subsystem of an embodiment of a restraint condition detection and notification system (for example, most any of the subsystems as disclosed in subsystem 102 of FIG. 1 or subsystem 202 of FIG. 2A) are engaged. The engagement of restraining elements indicates that the restraining device has been put into use, for example, to restrain limbs of (or the body of) a detainee. At 504, the system is activated. In some embodiments, sensors may be continuously powered, while in other embodiments, sensors may conserve power by slipping into a sleep mode. It is to be appreciated that step 504 also indicates that in those embodiments that employ a sleep mode, action that may indicate engagement may also disturb a sleep mode. Alternatively, sleep mode may be disturbed by a number of other manners, for example, a 'trip-wire' effect or other means, as may be known in the art. It is also to be appreciated, as has been discussed in relation to subsystems 102 of FIG. 1 and 202 of FIG. 2, that activation may occur in relation to step 502.

Once activated or sleep mode is disturbed, at 506 sensor detects a change to subsystem element. It is to be appreciated that such a change may be most any of the changes as discussed herein, or some other change to subsystem elements. Sensor detection may include static or dynamic capture. Step 506 in some embodiments may also include use of communication components of the system. At 508, the change is evaluated. It is to be appreciated that in some embodiments, evaluation may occur within a subsystem local to a restraining device, while in other embodiments, evaluation may occur outside of a subsystem and intermediate or distant from the restraining device. At 510, evaluation may indicate that threshold has been transgressed. If "no," at 512, the subsystem may return to sleep mode. It is to be appreciated that in some embodiments, data capture of items below a threshold may still be captured and trended, and such may provide an alarm or notification condition of its own accord.

If a threshold is transgressed, then at 514 an alarm condition may be activated. It is to be appreciated that the alarm condition may provide for either local or distant (or both) indications and notifications.

In some embodiments, the method may provide for determining whether a breach of the restraining elements has occurred. If no breach is detected, the system may still be configured to provide a notice or indication or both of a tamper alert mode. Embodiments with this step may provide an advantage of detecting and notifying detainee actions prior to a successful breach. If a breach does occur, then at 520, the system may indicate that a breach has occurred. It is to be appreciated that such an indication may be along the capabilities as disclosed for the embodiments of the system or may include other indications.

At step 522, which may occur throughout the method, a detection/notification may be turned off or reset. It should be appreciated that such an event may be indicated by a "proper" release of a detainee's limbs as desired by a controlling entity. It is also to be appreciated that circumstances may arise in which a controlling entity may desire to turn off or reset the system, for example, for troubleshooting or maintenance. It is further to be appreciated, that the system may have served its desired ends and is being 'retired' from immediate service, and as such, it may be desired to turn off the system. In some embodiments, a deactivation or reset may be provided by way of a timed interval lapsing.

Alternate methods may include placing restraining device elements securely around limbs of a detainee and engaging a locking mechanism. Upon detection of abnormal conditions by sensors, such as placement of the restraining device elements consistent with a possible escape attempt (for example, at an angle likely to indicate the device is behind the back of the employee when the captor initially place the restraining device in front of the detainee), triggering an alarm condition along a variety of audible, visual, tactile or other alarm modes (which, it is to be appreciated may be one or more modes in combination), thereby providing detection notification to a controlling entity. It is to be appreciated that preset conditions such as the appropriate position of the restraining device in relation to the detainee, the appropriate speed of the restraining device in relation the vehicle transporting the detainee, and the like may be programmed by captors. Further aspects of the innovation include situational adjustment capabilities. For example, additional sensors may be located in a vehicle used to transport a plurality of detainees, and sensor conditions of the vehicle (including for example, amount of expected time in transit, or path of transit) may be captured in the system. In addition, or in other situations, additional specialty items, such as for example, wireless link tags and control devices may also be utilized in the system.

Figure 6:
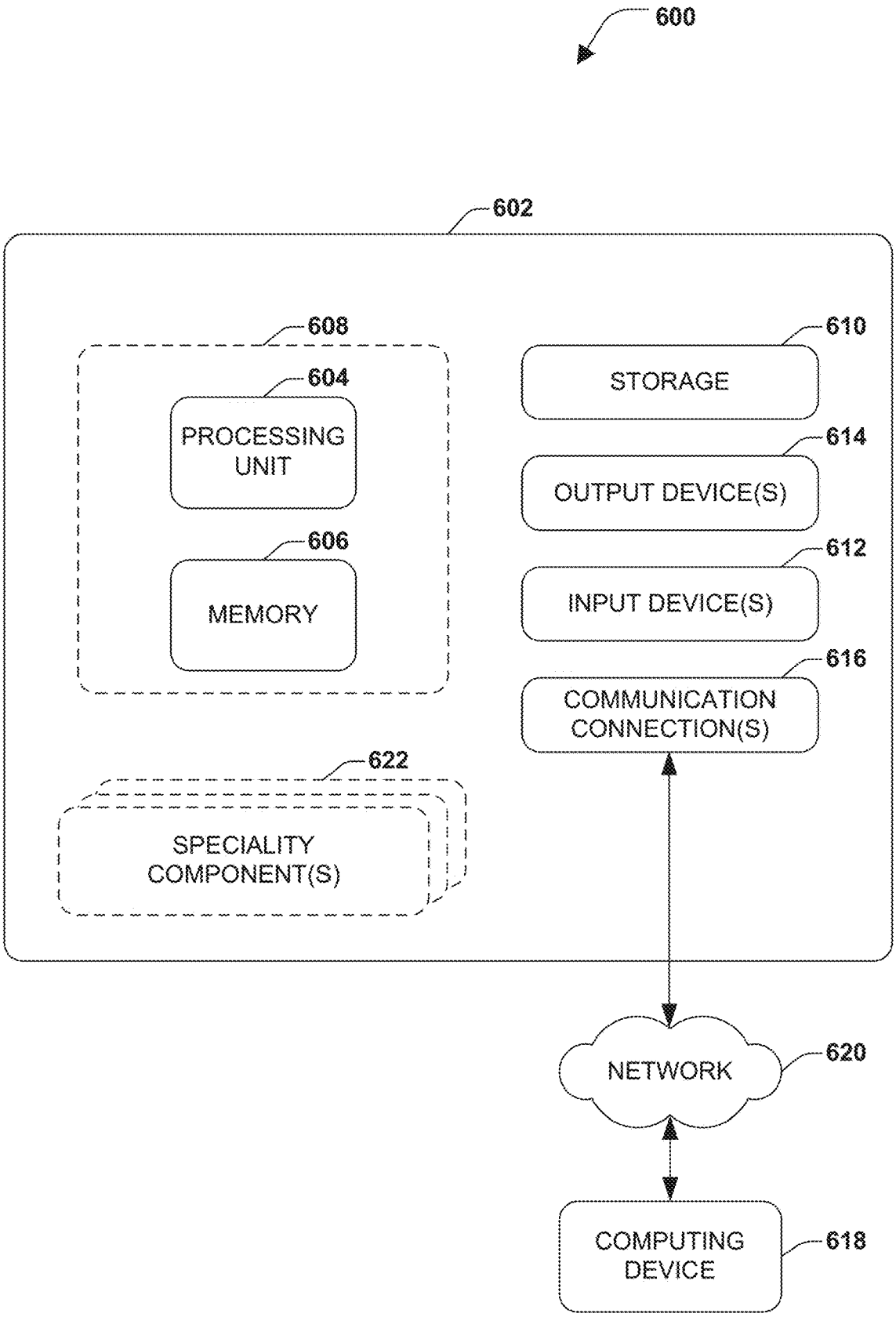
FIG. 6 is an illustration of an example technical environment where one or more of the provisions set forth herein can be implemented, according to one or more embodiments.

FIG. 6 and the following discussion provide a description of a suitable computing environment to implement embodiments of one or more of the provisions set forth herein. The operating environment of FIG. 6 is merely one example of a suitable operating environment and is not intended to suggest any limitation as to the scope of use or functionality of the operating environment. Example computing devices include, but are not limited to, personal computers, server computers, hand-held or laptop devices, mobile devices, such as mobile phones, Personal Digital Assistants (pdas), media players, and the like, multiprocessor systems, consumer electronics, mini computers, mainframe computers, distributed computing environments that include any of the above systems or devices, etc.

Generally, embodiments are described in the general context of "computer readable instructions" being executed by one or more computing devices. Computer readable instructions may be distributed via computer readable media as discussed herein. Computer readable instructions may be implemented as program modules, such as functions, objects, Application Programming Interfaces (apis), data structures, and the like, that perform one or more tasks or implement one or more abstract data types. Typically, the functionality of the computer readable instructions are combined or distributed as desired in various environments.

FIG. 6 illustrates a system 600 including a computing device 602 configured to implement one or more embodiments provided herein. In one configuration, computing device 602 includes at least one processing unit 604 and memory 606. Depending on the exact configuration and type of computing device, memory 606 may be volatile, such as RAM, non-volatile, such as ROM, flash memory, etc., or a combination of the two. This configuration is illustrated in FIG. 6 by dashed line 608.

In other embodiments, device 602 includes additional features or functionality. For example, device 602 may include additional storage such as removable storage or non-removable storage, including, but not limited to, magnetic storage, optical storage, etc. Such additional storage is illustrated in FIG. 6 by storage 610. In one or more embodiments, computer readable instructions to implement one or more embodiments provided herein are in storage 610. Storage 610 may store other computer readable instructions to implement an operating system, an application program, etc. Computer readable instructions may be loaded in memory 606 for execution by processing unit 604, for example.

The term "computer readable media" as used herein includes computer storage media. Computer storage media includes volatile and nonvolatile, removable and non-removable media implemented in most any method or technology for storage of information such as computer readable instructions or other data. Memory 606 and storage 610 are examples of computer storage media. Computer storage media includes, but is not limited to, RAM, ROM, EEPROM, flash memory or other memory technology, CD-ROM, Digital Versatile Disks (dvds) or other optical storage, magnetic cassettes, magnetic tape, magnetic disk storage or other magnetic storage devices, or most any other medium which may be used to store the desired information and which may be accessed by device 602. Any such computer storage media may be part of device 602.

Device 602 includes input device(s) 612 such as keyboard, mouse, pen, voice input device, touch input device, infrared cameras, video input devices, or most any other input device. Output device(s) 614 such as one or more displays, speakers, printers, or most any other output device may be included with device 602. Input device(s) 612 and output device(s) 614 may be connected to device 602 via a wired connection, wireless connection, or most any combination thereof. In one or more embodiments, an input device or an output device from another computing device may be used as input device(s) 612 or output device(s) 614 for computing device 602. Device 602 may include communication connection(s) 616 to facilitate communications with one or more other devices 618, and such communication may occur over a network, for example network 620. It is to be appreciated that communication over a network, for example network 620 may be to a number of different items or sources. For example, network 620 may be in communication with data stores, either of proprietary nature, such as 624 or of a public nature, such as 626. Further, computing device 618 may represent a plurality of computing devices, each of which may be owned by a single entity or may be owned separately by different entities, or may have a plurality of devices owned by a single entity and another plurality owned by one or more separate entities. Network 620 may also be in communication with rules, of which, for example, legal and limit restriction rules may be a type of rules in communicative connection with network 620.

Additionally, modules or components may be provided that are specialty components 622. Specialty components 622 may be configured, for example, in order to transform data structures in a particular manner, or for another example, specialty components 622 may enable machine learning processes to interact with data sets. Other specialty components 622 may be configured to provide interactions with users in either a bulk or batch mode, or in an interactive setting, or as discussed in the various figures herein.

Although, in accordance with some aspects, the subject matter has been described herein in language specific to structural features or methodological acts, it is to be understood that the subject matter of the appended claims is not necessarily limited to the specific features or acts described above. Rather, the specific features and acts described above are disclosed as example embodiments.

Further, the claimed subject matter may be implemented as a method, apparatus, or article of manufacture by using standard programming or engineering techniques to produce a novel ordered combination of software, firmware, hardware, or most any combination thereof to control a computer to implement the disclosed subject matter. The term "article of manufacture" as used herein is intended to encompass a computer program accessible from most any computer-readable device, carrier, or media. Of course, many modifications may be made to this configuration without departing from the scope or spirit of the claimed subject matter.

Various operations of embodiments are provided herein. The order in which one or more or all of the operations are described should not be construed as to imply that these operations are necessarily order dependent. Alternative ordering will be appreciated based on this description. Further, not all operations may necessarily be present in each embodiment provided herein.

As used in this application, "or" is intended to mean an inclusive "or" rather than an exclusive "or". Further, an inclusive "or" may include any combination thereof (e.g., A, B, or any combination thereof). In addition, "a" and "an" as used in this application are generally construed to mean "one or more" unless specified otherwise or clear from context to be directed to a singular form. Additionally, at least one of A and B and/or the like generally means A or B or both A and B. Further, to the extent that "includes", "having", "has", "with", or variants thereof are used in either the detailed description or the claims, such terms are intended to be inclusive in a manner similar to the term "comprising" as "comprising" is interpreted when employed as a transitional word in a claim.

Further, unless specified otherwise, "first", "second", or the like are not intended to imply a temporal aspect, a spatial aspect, an ordering, etc. Rather, such terms are merely used as identifiers, names, etc. For features, elements, items, etc. For example, a first channel and a second channel generally correspond to channel A and channel B or two different or two identical channels or the same channel. Additionally, "comprising", "comprises", "including", "includes", or the like generally means comprising or including, but not limited to.

Although the disclosure has been shown and described with respect to one or more implementations, equivalent alterations and modifications will occur based on a reading and understanding of this specification and the annexed drawings. The disclosure includes all such modifications and alterations and is limited only by the scope of the following claims.

What has been described above includes examples of the innovation. It is, of course, not possible to describe every conceivable combination of components or methodologies for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims.

What is claimed is:

1. A system, comprising:

a restraining device;

associated with a sensor that selectively detects a condition of the restraining device, wherein the sensor detects an interaction with a connecting element fixed to the restraining device, wherein the interaction indicates a sensed value above a threshold and the indication is at least one of vibration, torsion, stress, friction or distance; and a communication component that selectively communicates a sensed condition of the restraining device, wherein the sensed condition reflects a status of the restraining device, wherein the status reflects the sensed value above or below a threshold.

2. The system of claim 1, further comprising:

a control element that receives the sensed condition of the restraining device from the communication component and selectively provides an indication of a tamper attempt or restraint failure.

3. The system of claim 2, wherein the indication is at least one of an auditory alarm, a visual indication, or a tactile indication.

4. The system of claim 1, wherein the sensor detects a presence of a proper key, and the sensed condition is a disarm action of the restraining device.

5. The system of claim 4, wherein the presence is detected by a nearfield switch in proximity of a clip mechanism.

6. The system of claim 4, wherein the disarm action is detected by at least one of a rocker switch or a rotary encoder mechanism.

7. The system of claim 4, wherein the presence of the proper key is detected based upon a configuration of a keyway for a standard key having sensing elements that detect a presence of the standard key.

8. The system of claim 7, wherein the detection is accomplished by at least one of a detect mechanism and a plate switch.

9. The system of claim 7, wherein the detection is conducted by at least one of a plurality of embedded elements provided in a substitute for a standard key, wherein the embedded elements provide a finished circuit, a magnetic switch output, a preselected emitter, and a physical mechanism that selectively engages a spring-post mating mechanism of the restraining device.

10. A method of providing restraint condition, comprising:

activating a sensor after application of a restraint device;

detecting, by way of the sensor, a change to a selected parameter of the restraint device, wherein the detecting indicates an interaction with a connecting element between a pair of restraints that indicates a sensed value above a threshold;

evaluating the change to determine whether at least one of a plurality of thresholds have been exceeded; and after determination of an exceeded threshold, activating a communication component to indicate at least one of a tamper alert or a breach alert.

11. The method of claim 10, wherein the act of detecting, by way of the sensor, detects a presence of a proper key that is employed in an opening action of the restraint device.

12. The method of claim 11, wherein the act of detecting of the presence is detected based on a configuration of a keyway of the restraint device for a standard key having sensing elements that detect a presence of the standard key.

* * * * *